US007198111B2

(12) United States Patent
Dierker, Jr. et al.

(10) Patent No.: US 7,198,111 B2
(45) Date of Patent: Apr. 3, 2007

(54) AUTOMOTIVE VEHICLE WITH FIRE SUPPRESSION SYSTEM

(75) Inventors: Joseph B. Dierker, Jr., Troy, MI (US); Robert H. Thompson, Redford, MI (US); Lauren M. Newton, Brookfield, WI (US); Richard D. Cupka, Jr., Saline, MI (US); James A. Anderson, Farmington Hills, MI (US); Todd N. Clark, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/907,134

(22) Filed: Mar. 22, 2005

(65) Prior Publication Data

US 2006/0213674 A1 Sep. 28, 2006

(51) Int. Cl.

| | |
|---|---|
| ***A62C 3/07*** | (2006.01) |
| ***A62C 35/00*** | (2006.01) |
| ***A62C 37/10*** | (2006.01) |
| ***A62C 37/00*** | (2006.01) |
| ***A62C 3/00*** | (2006.01) |
| ***A62C 35/58*** | (2006.01) |

(52) U.S. Cl. ..... 169/62; 169/61; 169/60; 169/56; 169/85; 169/46

(58) Field of Classification Search ..... 169/62, 169/61, 60, 56, 85, 46, 54, 84, 9, 16, 71
See application file for complete search history.

(56) References Cited

U.S. PATENT DOCUMENTS

| | | | | |
|---|---|---|---|---|
| 4,132,271 A | | 1/1979 | Mikaila | |
| 5,129,386 A | * | 7/1992 | Meister | 126/299 R |
| 5,590,718 A | | 1/1997 | Bertossi | |
| 5,613,564 A | | 3/1997 | Rhines | |
| 5,762,145 A | | 6/1998 | Bennett | |
| 5,808,541 A | * | 9/1998 | Golden | 340/286.05 |
| 5,918,681 A | | 7/1999 | Thomas | |
| 5,934,379 A | | 8/1999 | Ostlyngen et al. | |
| 5,960,888 A | * | 10/1999 | Moore, Sr. | 169/62 |
| 5,992,528 A | | 11/1999 | Parkinson et al. | |
| 6,164,383 A | | 12/2000 | Thomas | |
| 6,352,121 B1 | * | 3/2002 | Pitell et al. | 169/62 |
| 6,981,555 B2 | * | 1/2006 | Smith et al. | 169/62 |
| 2004/0084193 A1 | | 5/2004 | Tseng | |
| 2004/0226726 A1 | * | 11/2004 | Holland et al. | 169/62 |

* cited by examiner

*Primary Examiner*—Kevin Shaver
*Assistant Examiner*—Darren Gorman
(74) *Attorney, Agent, or Firm*—Frank A. MacKenzie

(57) ABSTRACT

An automotive vehicle includes a vehicle body and at least one reservoir containing a fire suppressant agent. A distribution system receives the fire suppression agent from the reservoir and conducts the agent to at least one location about the vehicle's body in response to the determination by a sensor system and controller that the vehicle has been subjected to a significant impact. The sensor system and controller determine not only the magnitude of an impact upon the vehicle, but also track subsequent motion of the vehicle, as well as the time which has elapsed since an impact, so as to decide if and when the fire suppressant agent should be dispersed. Alternatively, the fire suppressant agent may be dispersed following activation of a manual switch.

29 Claims, 6 Drawing Sheets

AUTOMOTIVE VEHICLE WITH FIRE SUPPRESSION SYSTEM

FIELD OF THE INVENTION

The present invention relates to an automotive vehicle having an onboard apparatus for suppressing a vehicle fire.

DISCLOSURE INFORMATION

Police vehicles are subject to increased exposure to collisions, particularly high-speed rear-end collisions, arising from the need for police officers to stop on the shoulders, or even in the traffic lanes, of busy highways. Unfortunately, other motorists are known to collide with police vehicles employed in this manner. These accidents can compromise the fuel system on any vehicle and may cause fires. The present system is designed to suppress the spread of, or potentially, to extinguish such a fire. U.S. Pat. No. 5,590,718, discloses an anti-fire system for vehicles in which a number of fixed nozzles are furnished with a fire extinguishing agent in response to an impact sensor. The system of the '718 patent suffers from a problem in that the release of the extinguishing agent is triggered immediately upon receipt of a significant impact. As a result, the anti-fire agent may be expended before the vehicle comes to a halt, with the further result being that a subsequent fire might not be treated by the system. Also, the '718 patent uses a valving system which could become clogged and therefore inoperable. U.S. Pat. No. 5,918,681 discloses a system which is similar to that disclosed in the '718 patent, inasmuch as the fire extinguishing system does not take into account movement of the vehicle following subjection of the vehicle to an impact. Finally, U.S. Pat. No. 5,762,145 discloses a fuel tank fire protection device including a powdered extinguishing agent panel attached to the fuel tank. In general, powder delivery systems are designed to prevent ignition of fires and are deployed upon impact. As a result, the powder may not be able to follow the post-impact movement of the struck vehicle and may not be able to prevent the delayed ignition or re-ignition of a fire.

The present fire suppression system provides significant advantages, as compared with prior art vehicular fire suppression systems.

SUMMARY OF THE INVENTION

An automotive vehicle according to the present invention includes a vehicle body and at least one reservoir containing a fire suppressant agent. The reservoir containing a fire suppression agent is mounted in proximity to the body, preferably within the body or on an external surface of the body. A sensor system determines whether the vehicle has been subjected to an impact and also whether the vehicle is moving subsequent to such an impact. A distribution system receives the fire suppressant agent from the reservoir and conducts the fire suppressant agent to at least one location about the body, either internally or externally thereto. Finally, a controller operatively connected with the sensor system and the reservoir causes the reservoir to initiate delivery of the fire suppressant agent from the reservoir through the distribution system in the event that a significant impact having a suitable magnitude, duration, and other characteristics, is sensed.

According to another aspect of the present invention, the fire suppressant reservoir includes a tank for the suppressant agent and a propellant for establishing pressure within the tank sufficient to deliver suppressant agent from the tank to the distribution system. The propellant may take the form of either a pyrotechnic gas generator, or a canister containing compressed gas, or yet other types of propellants known to those skilled in the art and suggested by this disclosure.

According to another aspect of the present invention, the distribution system for the fire suppressant agent includes a number of conduits connected with the reservoir, with the conduits feeding a number of nozzles which may include both fixed and variable geometry nozzles. Release of the fire suppressant agent is governed by the controller, which is operatively connected with at least one accelerometer for sensing vehicle impact and at least one speed sensor for sensing vehicle speed.

In addition to the automatic deployment of the fire suppression system provided by the controller, a manually activatable switch is provided for causing the reservoir to initiate delivery of the fire suppressant agent from the reservoir to the distribution system. The manually activatable switch includes a manual pushbutton mounted upon a platform which is responsive not only to manual displacement of the pushbutton, but also to manual displacement of the platform itself.

According to another aspect of the present invention, a method for operating a fire suppression system installed in an automotive vehicle includes the steps of sensing an impact upon the vehicle, sensing the vehicle's speed following the impact, and discharging a fire suppression agent from an onboard reservoir in the event that the vehicle speed crosses a predetermined speed threshold following the sensing of an impact. As a variation of this method, a further step involves discharging the fire suppression agent only if the previous conditions are satisfied, as well as the additional condition that the vehicle is not experiencing acceleration in excess of a predetermined acceleration threshold.

The fire suppression agent will be discharged after a predetermined period of time following a significant, or triggering, impact upon the vehicle, regardless of subsequent vehicle speed or acceleration. In this manner, the fire suppression agent will be discharged in the event that the vehicle does not move following an impact. This also permits the system to discharge the suppression agent even if the system's sensors are damaged during an impact.

The sensor system used with the present fire suppression system may be combined with a control system for an occupant restraint airbag or other occupant restraints.

The present fire suppression system represents an advantage over other known systems because it has the capability to suppress a fire without the wheel "shadowing" which would otherwise occur if the flow of fire suppression agent were blocked by one or more wheels when the vehicle is stopped.

The present fire suppression system offers the additional advantage of not only automatic actuation, but also manual actuation, so as to allow the vehicle's operator to discharge the system even when the vehicle has not suffered a significant impact.

The present system offers the additional advantage that both variable and fixed geometry nozzles are used to assure adequate dispersion of the fire suppression agent, with the integrity of the system being protected from both road splash and objects thrown up by the vehicle's wheels during normal operation of the vehicle. Because the variable geometry nozzles are normally tucked up into the vehicle underbody region well above the road surface, these nozzles are protected from damage which would otherwise result from law enforcement maneuvers such as striking curbs and driving off-road.

The present system offers the additional advantage that the system operates without the need for an optical or other type of fire sensor which could become obscured, and therefore inoperable, in a vehicle underbody environment. The absence of such sensors allows the present system to begin its activation sequence immediately upon receipt of data indicating a triggering impact.

The present system offers the additional advantage that the system operates in the event of impacts which are directed against a vehicle not only longitudinally, but also laterally.

The present fire suppression system is designed advantageously to help reduce the risk of injury in high-speed rear impacts. The fire suppression system deploys chemicals designed to suppress the spread of fire or potentially extinguish a fire, thereby providing more time for occupants to escape from a crashed vehicle.

Other advantages, as well as objects and features of the present invention will become apparent to the reader of this specification.

DETAILED DESCRIPTION OF THE PREFERRED EMBODIMENTS

Figure 1:
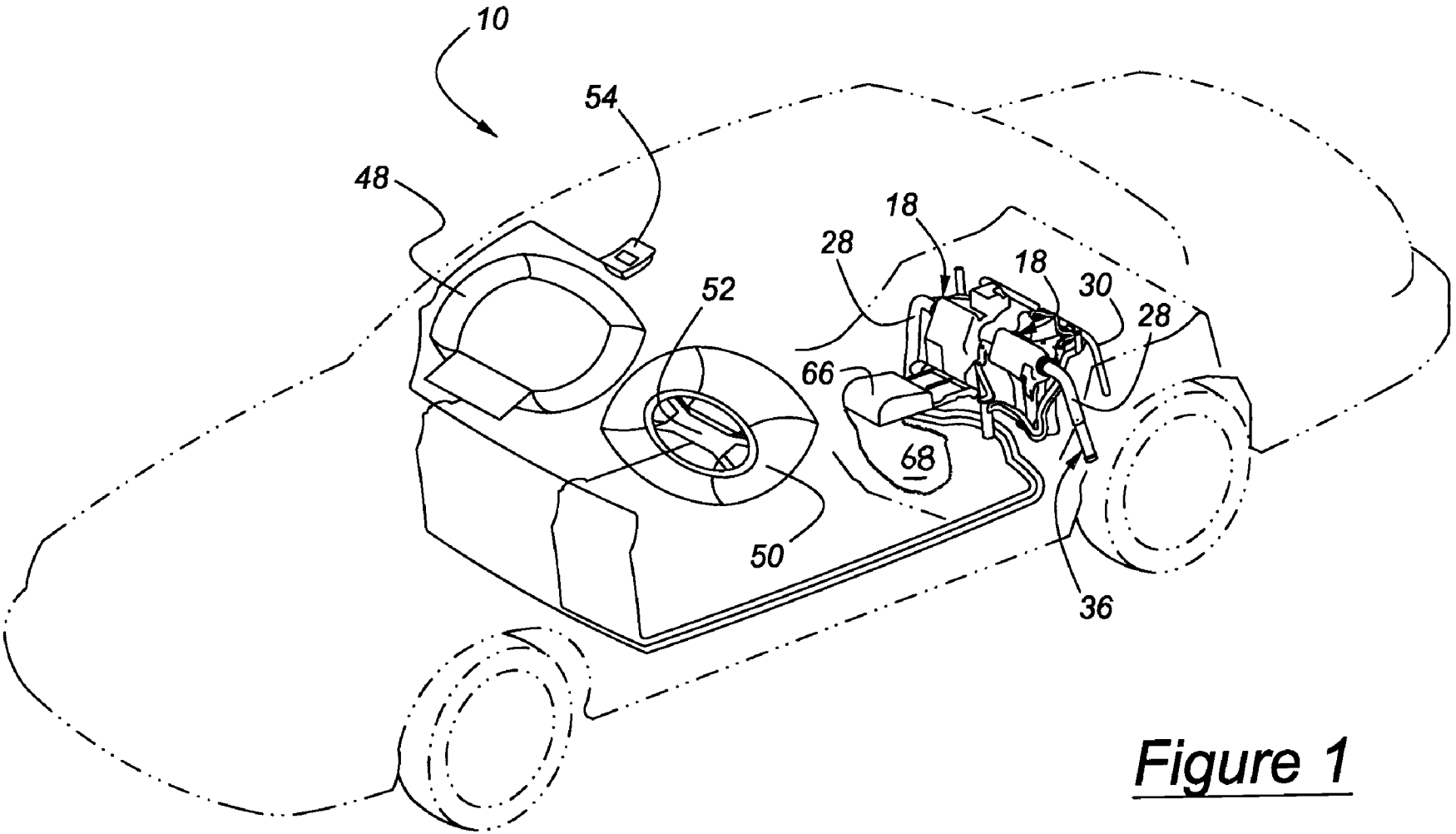
FIG. 1 is a ghost perspective view of an automotive vehicle having a fire suppression system according to the present invention.

As shown in FIG. 1, vehicle 10 has a passenger airbag restraint, 48, and a driver's airbag restraint, 50, mounted adjacent steering wheel 52. A fire suppression system includes controller 66 which is mounted upon floor pan 68 of vehicle 10, and reservoirs 18 which are mounted under floor pan 68 in the so-called kick-up area adjoining the rear axle of vehicle 10. Those skilled in the art will appreciate in view of this disclosure that additional passenger restraint devices, such as seat belt pretensioners and side airbags, may be installed in a vehicle and controlled at least in part by, or in conjunction with, controller 66.

Figure 2:
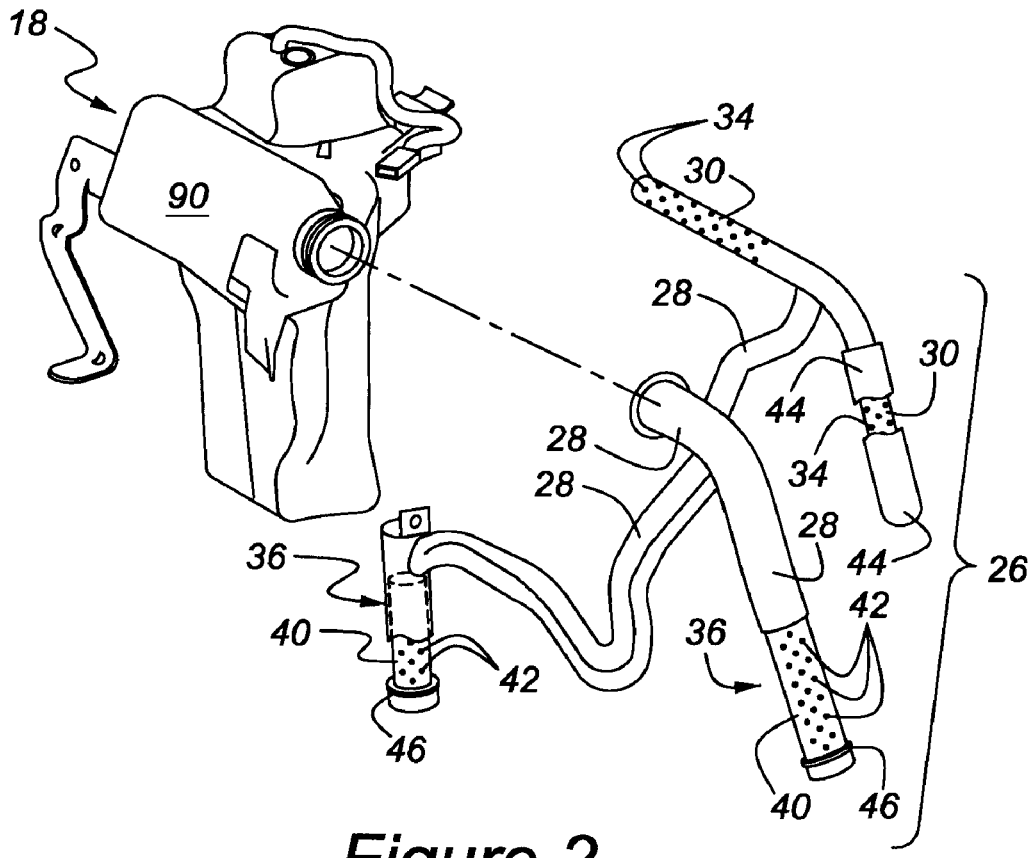
FIG. 2 is an exploded perspective view of a portion of a fire suppression system according to the present invention.
Figure 8:
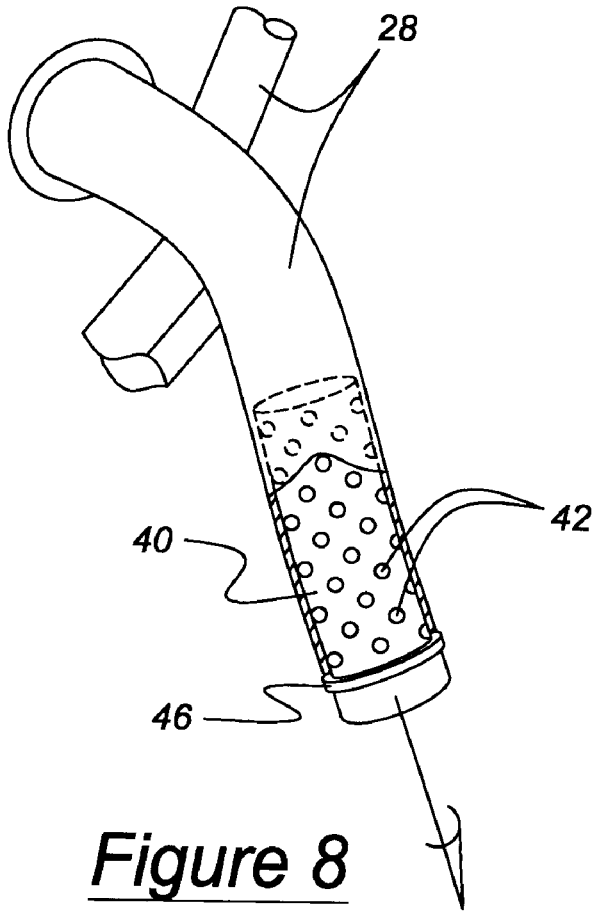
FIG. 8 is a perspective view of a variable geometry fire suppression agent nozzle according to one aspect of the present invention.

FIG. 1 shows not only reservoirs 18 but also a portion of right and left side fire suppression conduits 28, as well as fixed geometry nozzles 30 and variable geometry nozzles 36. As seen in FIG. 1, variable geometry nozzles 36 project downwardly to allow fire suppression agent to be expelled from reservoirs 18 and placed at a low angle to the ground surface the vehicle is operating upon. This mode of operation is possible because variable geometry nozzles 36 are, as shown in FIG. 2, telescopingly extensible. This telescoping feature, which is shown in greater detail in FIG. 8, is produced by a sliding spray head, 40, which is slidingly engaged with conduit 28 such that gas pressure within conduit 28 forces spray head 40 downwardly into its extended position, causing fire suppression agent 22 to be discharged through a number of holes 42 formed in spray head 40. As shown in FIG. 2, at least two variable geometry nozzles 36 may be employed with single reservoir 18, along with at least two fixed nozzles 30 which are spray bars each having a number of orifices 34. While in their normally closed state, variable geometry nozzles 36 are liquid-tight by virtue of seals 46, which are interposed between an end of each of spray heads 40 and the corresponding ends of conduits 28. In a preferred embodiment, seals 46 comprise elastomeric boots attached to an outer surface of conduit 28. Seals 46 are simply sheared by the deploying spray head 40 when the present system is discharged. Fixed nozzles 30 are also rendered liquid-tight by covers 44, which are simply blown off when the present system is discharged. The sealing of nozzles 30 and 36 is important, because this prevents the ingress of road splash, which could block the system in sub-freezing weather or cause corrosion or blockage due to mud or other foreign matter.

Figure 7:
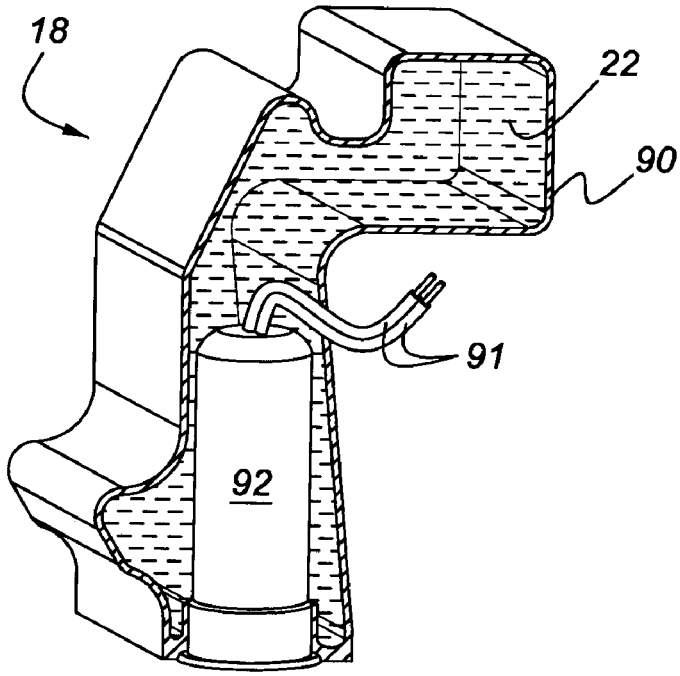
FIG. 7 is a cutaway perspective view of a fire suppression agent reservoir according to one aspect of the present invention.

Additional details of reservoir 18 are shown in FIG. 7. Tank 90 contains approximately 1.5 L of fire suppression agent 22, and a propellant 92. Propellant 92 includes two squibs (not shown) which are activated simultaneously by controller 66 via lines 91 so as to release a large amount of gas, forcing fire suppressant agent 22 from tank 90 and into distribution system 26, including conduit 28 and the various fixed and variable geometry nozzles. A preferred propellant, marketed by Primex Aerospace Company as model FS01-40, is a mixture including aminotetrazole, strontium nitrate, and magnesium carbonate. This is described in U.S. Pat. No. 6,702,033, which is hereby incorporated by reference into this specification.

Those skilled in the art will appreciate in view of this disclosure that other types of propellants could be used in the present system, such as compressed gas canisters and other types of pyrotechnic and chemical devices capable of creating a gas pressure force in a vanishingly small amount of time. Moreover, fire suppressant agent 22, which preferably includes a water-based solution with hydrocarbon surfactants, fluorosurfactants, and organic and inorganic salts sold under the trade name LVS Wet Chemical Agent® by Ansul Incorporated, could comprise other types of agents such as powders or other liquids, or yet other agents known to those skilled in the art and suggested by this disclosure. If two reservoirs 18 are employed with a vehicle, as is shown in FIG. 1, all four squibs will be deployed simultaneously.

Figure 4:
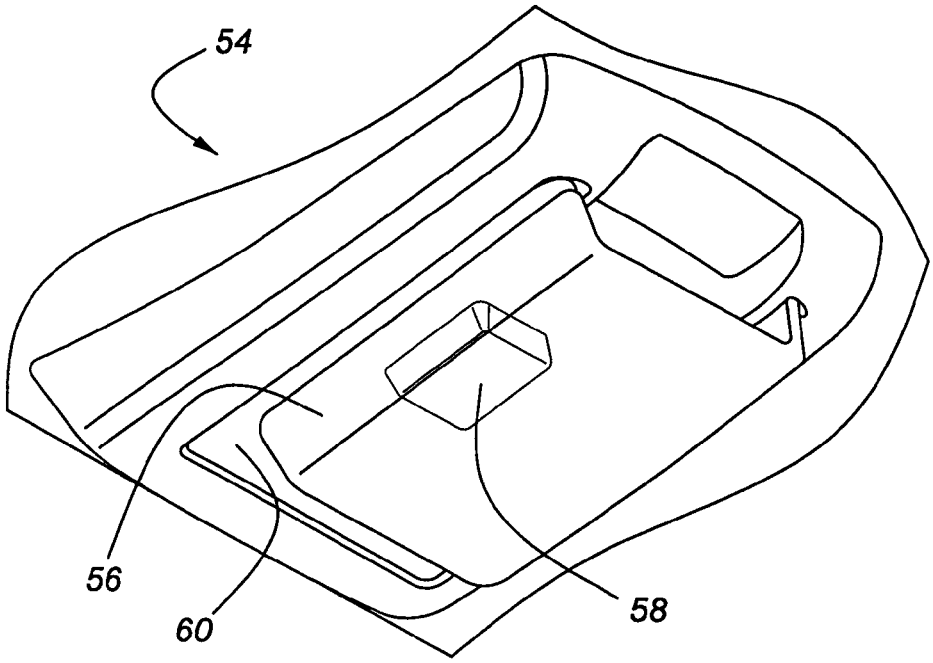
FIG. 4 is a perspective view of a manually activatable switch used with a fire suppression system according to the present invention.

FIG. 4 shows manually activatable switch 54 for use with the present system. As shown in FIG. 1, switch 54 may be advantageously located on the headliner of vehicle 10 between the sun visors, or at any other convenient position. To use this switch 54, hinged clear cover 56 is first opened by pressing on cover 56. Thereafter, the fire suppression system may be triggered by manually pressing pushbutton 58. If the vehicle occupants are not disposed to release cover 56, the system may be triggered by merely sharply depressing cover 56, thereby closing contacts (not shown) contained within platform 60.

Figure 3:
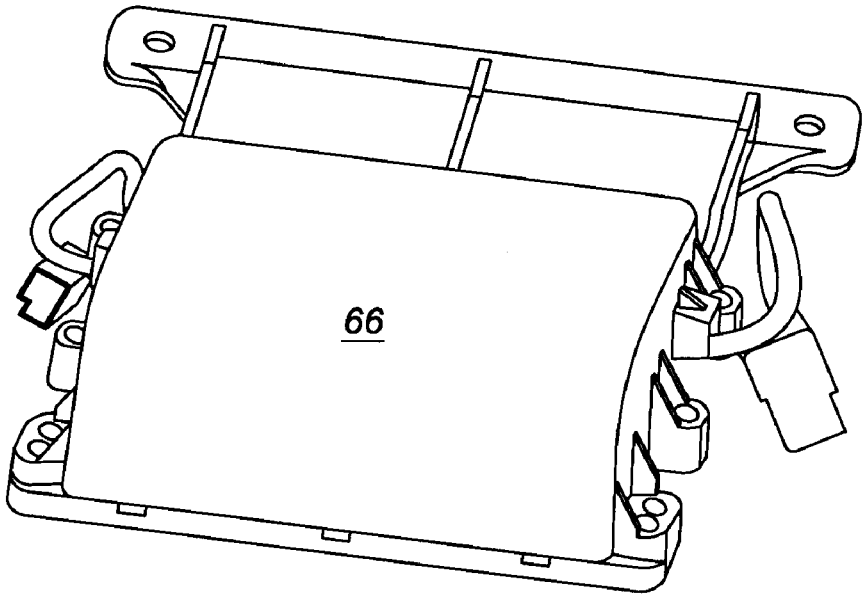
FIG. 3 is a perspective view of a control module used with a system according to the present invention.
Figure 5:
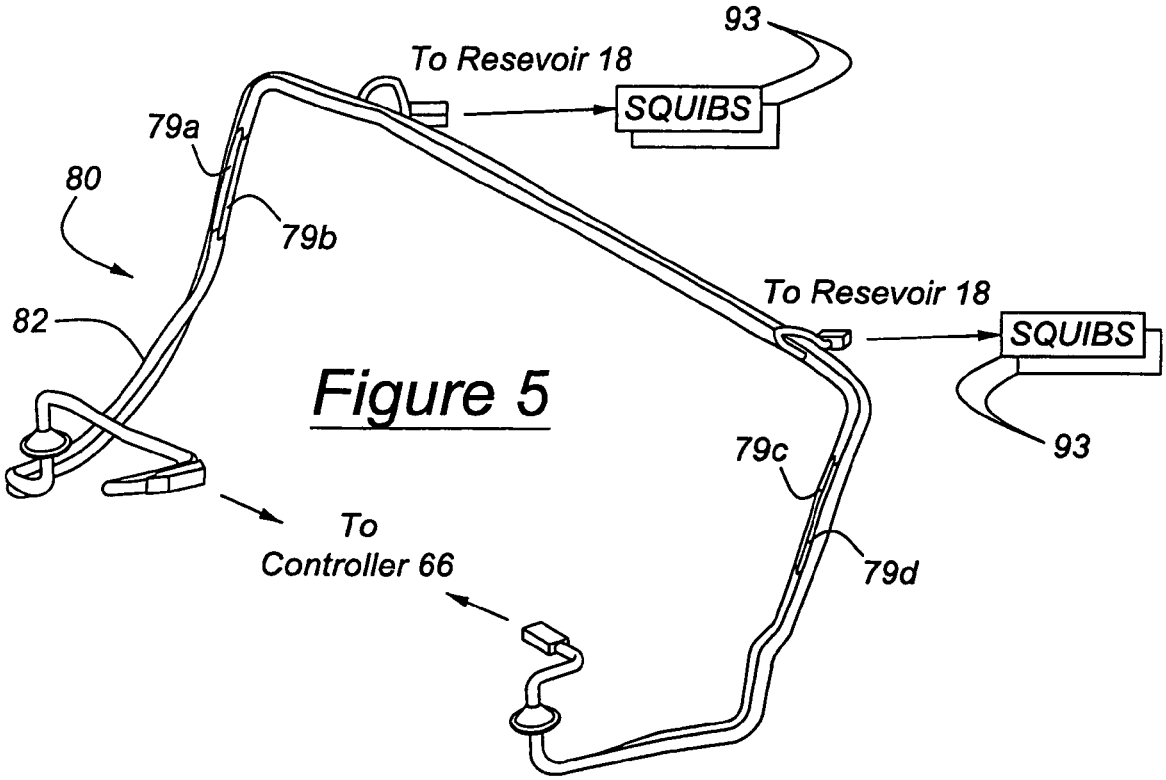
FIG. 5 illustrates a portion of a wiring harness used with the present system.

Because the present system is intended for use when the vehicle has received a severe impact, controller 66, which is shown in FIG. 3, contains a redundant power reserve or supply, which allows operation of the fire suppression system for about nine seconds, even if controller 66 becomes isolated from the vehicle's electrical power supply. Wiring harness 80, as shown in FIG. 5, is armored, and has a para-aramid fiber inner sheath, 82, of about 2 mm in thickness, which helps to shield the conductors within harness 80 from abrasion and cutting during a vehicle impact event. This para-aramid fiber is sold under the trade name KEVLAR® by the DuPont company. This armoring helps to assure that communication between controller 66 and reservoirs 18 remains in effect during an impact event. Post-impact communications are further aided by redundancy in the control system. Specifically, four independent sets of primary conductors, 79*a–d*, extend from controller 66 to reservoirs 18 protected by sheath 82. Moreover, an H-conductor, shown at 81 in FIG. 5, extends between reservoirs 18. Thus, if one or both of the primary conductors 79*a–b*, or 79*c–d*, extending to one of reservoirs 18 should become severed, H-conductor 81 will be available to carry the initiation signal from the undamaged lines to both of reservoirs 18.

Figure 9:
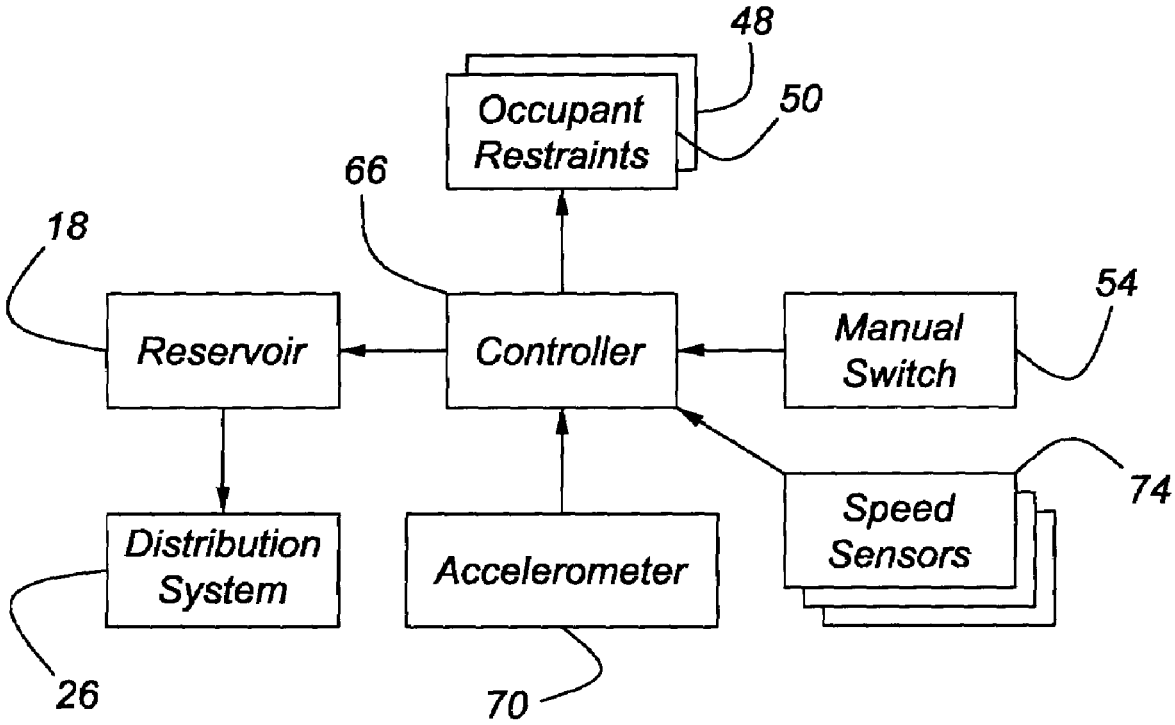
FIG. 9 is a block diagram of a fire suppression system and with additional components for occupant restraint according to one aspect of the present invention.

As noted above, an important feature of the present invention resides in the fact that the control parameters include not only vehicle impact, as measured by an accelerometer such as that shown at 70 in FIG. 9, but also vehicle speed, as measured by means of speed sensors 74, also shown in FIG. 9. Speed sensors 74 may advantageously be existing sensors used with an anti-lock braking system or vehicle stability system. Alternatively, speed sensors 74 could comprise a global positioning sensor or a radar or optically based ground-sensing system. Accelerometer 70, as noted above, could be used with a conventional occupant restraint airbag system, thereby maximizing use of existing systems within the vehicle. Advantageously, accelerometer 70 may be an amalgam of two or more accelerometers having differing sensing ranges. Such arrangements are known to those skilled in the art and suggested by this disclosure. At least a portion of the various sensors could either be integrated in controller 66 or distributed about vehicle 10.

Figure 6:
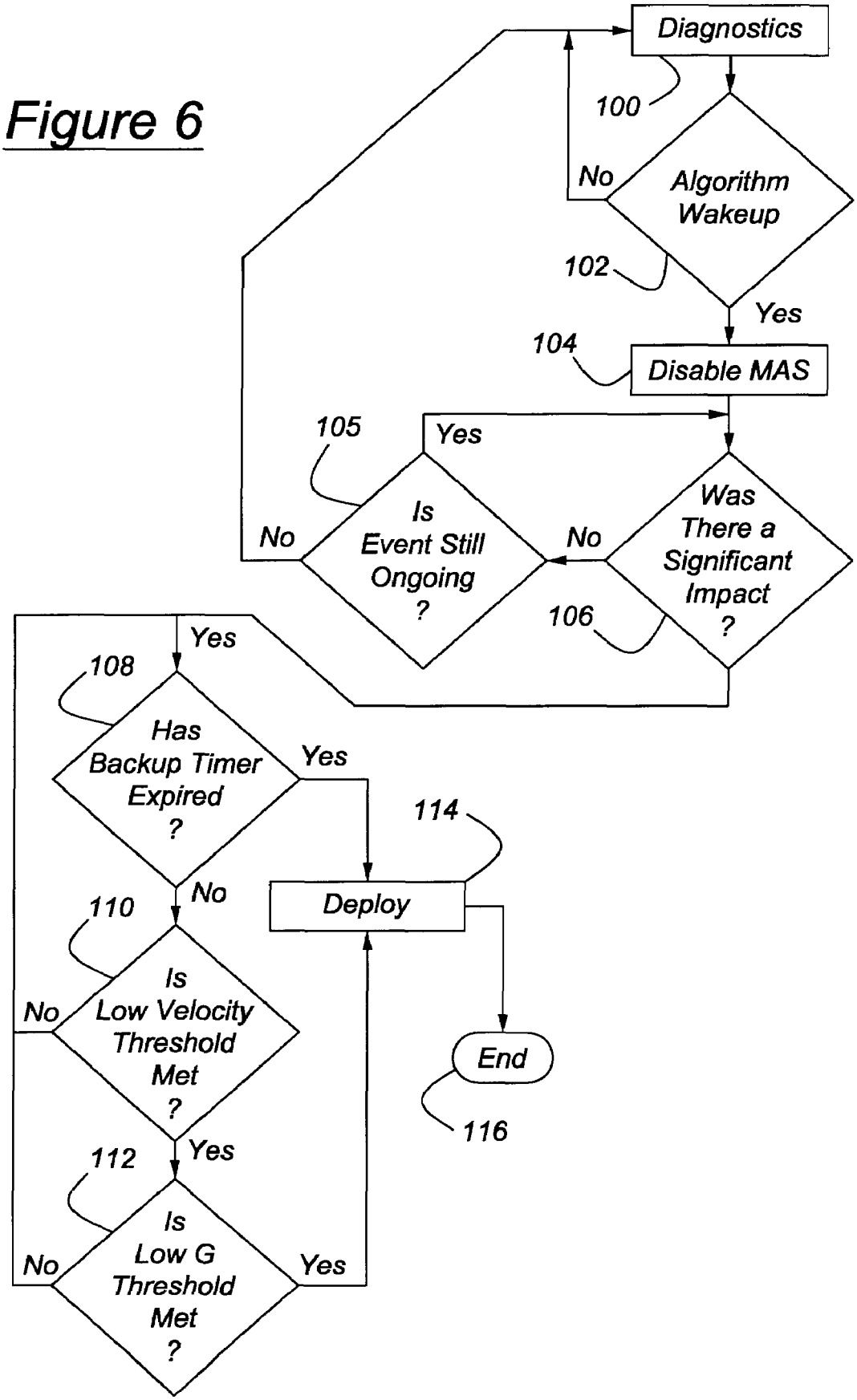
FIG. 6 is a flowchart showing a portion of the logic used to control a system according to the present invention.

FIG. 6 shows a sequence which is used according to one aspect of the present invention for activating a release of fire suppressant agent.

Beginning at block 100, controller 66 performs various diagnostics on the present system, which are similar to the diagnostics currently employed with supplemental restraint systems. For example, various sensor values and system resistances will be evaluated on a continuous basis. Controller 66 periodically moves to block 102, wherein the control algorithm will be shifted from a standby mode to an awake mode in the event that a vehicle acceleration, or, in other words, an impact, having a magnitude in excess of a relatively low threshold is sensed by accelerometer 70. Also, at block 102 a backup timer will be started. If the algorithm is awakened at block 102, controller 66 disables manually activatable switch 54 at block 104 for a predetermined amount of time, say 150 milliseconds. This serves to prevent switch 54 from inadvertently causing an out-of-sequence release of fire suppression agent. Note that at block 104, a decision has not yet been made to deploy fire suppression agent 22 as a result of a significant impact.

At block 106, controller 66 uses output from accelerometer 70 to determine whether there has been an impact upon vehicle 10 having a severity is in excess of a predetermined threshold impact value. Such an impact may be termed a significant, or "trigger", impact. If an impact is less severe than a trigger impact, the answer at block 106 is "no", and controller 66 will move to block 105, wherein an inquiry is made regarding the continuing nature of the impact event. If the event has ended, the routine moves to block 100 and continues with the diagnostics. If the event is proceeding, the answer at block 105 is "yes", and the routine loops to block 106.

If a significant impact is sensed by the sensor system including accelerometer 70 and controller 66, the answer at block 106 will be "yes." If such is the case, controller 66 moves to block 108 wherein the status of a backup timer is checked. This timer was started at block 102.

Once the timer within controller 66 has counted up to a predetermined, calibratable time on the order of, for example, 5–6 seconds, controller 66 will cause propellant 92 to initiate delivery of fire suppressant agent 22, provided the agent was not released earlier. Propellant 92 is activated by firing an electrical squib so as to initiate combustion of a pyrotechnic charge. Alternatively, a squib may be used to pierce, or otherwise breach, a pressure vessel. Those skilled in the art will appreciate in view of this disclosure that several additional means are available for generating the gas required to expel fire suppressant agent 22 from tank 90. Such detail is beyond the scope of this invention. An important redundancy is supplied by having two squibs, 93, (FIG. 5), located within each of tanks 90. All four squibs are energized simultaneously.

The velocity of the vehicle 10 is measured at block 110 using speed sensors 74, and compared with a low velocity threshold. In essence, controller 66 processes the signals from the various wheel speed sensors 74 by entering the greatest absolute value of the several wheel speeds into a register. This register contains both a weighted count of the number of samples below a threshold and a count of the number of samples above the threshold. When the register value crosses a threshold value, the answer at block 110 becomes "yes". In general, the present inventors have determined that it is desirable to deploy fire suppression agent 22 prior to the vehicle coming to a stop. For example, fire suppression agent 22 could be dispersed when the vehicle slows below about 15 kph.

At block 112, controller 66 enters a measured vehicle acceleration value into a second register. Thereafter, once the acceleration register value decays below a predetermined low g threshold, the answer becomes "yes" at block 112, and the routine moves to block 114 and releases fire suppressant agent 22. In essence, a sensor fusion method combines all available sensor information to verify that the vehicle is approaching a halt. The routine ends at block 116. Because the present fire suppression system uses all of the available fire suppression agent 22 in a single deployment, the system cannot be redeployed without replacing at least reservoirs 18.

FIG. 6 does not include the activation of occupant restraints 48 and 50, it being understood that known control sequences, having much different timing constraints, may be employed for this purpose. In point of contrast, the low velocity threshold allows the present system to deliver the fire suppression agent while the vehicle is still moving, albeit at a very low velocity. This prevents the rear wheels of the vehicle from shadowing, or blocking dispersion of fire suppressant agent 22. Also, in many cases, a vehicular fire may not become well-established until the vehicle comes to a halt.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. An automotive vehicle, comprising:

a vehicle body;

a reservoir containing a fire suppressant agent, with said reservoir being mounted in proximity to said body;

a distribution system for receiving the fire suppressant agent from said reservoir and for conducting the fire suppressant agent to at least one location about said body; a sensor system for determining whether the vehicle has been subjected to an impact and whether the vehicle is moving subsequent to such an impact; and a controller, operatively connected with said sensor system and said reservoir, for causing said reservoir to initiate delivery of the fire suppressant agent from the reservoir to the distribution system.

2. An automotive vehicle according to claim 1, wherein said reservoir comprises a tank containing a supply of suppression agent and a propellant for establishing a pressure within said tank sufficient to at least deliver the suppression agent from the tank to the distribution system.

3. An automotive vehicle according to claim 2, wherein said propellant comprises a pyrotechnic gas generator.

4. An automotive vehicle according to claim 2, wherein said propellant comprises a canister containing a compressed gas.

5. An automotive vehicle according to claim 1, wherein said distribution system comprises a plurality of conduits connected with said reservoir, with said conduits feeding a plurality of nozzles.

6. An automotive vehicle according to claim 5, wherein said plurality of nozzles comprises at least one pressure-responsive, variable geometry nozzle.

7. An automotive vehicle according to claim 5, wherein said plurality of nozzles comprises a plurality of pressure-responsive, variable geometry nozzles and a plurality of fixed geometry nozzles.

8. An automotive vehicle according to claim 1, wherein said sensor system comprises at least one accelerometer operatively connected with said controller.

9. An automotive vehicle according to claim 1, wherein said sensor system comprises at least one roadwheel speed sensor operatively connected with said controller.

10. An automotive vehicle according to claim 1, wherein said sensor system comprises a global positioning sensor operatively connected with said controller.

11. An automotive vehicle according to claim 1, further comprising a manually activatable switch for causing the reservoir to initiate delivery of the fire suppressant agent from the reservoir to the distribution system.

12. An automotive vehicle according to claim 11, wherein said manually activatable switch comprises a manual pushbutton mounted upon a platform, and a platform contact set responsive to manual displacement of said pushbutton as well as to manual displacement of a pivoting cover attached to the switch.

13. A method for operating a fire suppression system installed in an automotive vehicle, comprising the steps of:

sensing an impact upon the vehicle;

sensing the vehicle's speed following the impact; and discharging a fire suppression agent from an onboard reservoir in the event that the vehicle's speed crosses a predetermined speed threshold following sensing of an impact.

14. A method for operating a vehicular fire suppression system according to claim 13, further comprising the step of discharging said fire suppression agent after a predetermined period of time following an impact upon the vehicle, in the event that the fire suppression agent was not previously discharged.

15. A method according to claim 13, wherein said predetermined speed threshold comprises a value greater than zero.

16. A method according to claim 13, wherein said fire suppression system incorporates a manually activatable switch which is rendered inoperative for a predetermined period of time following the sensing of an impact upon the vehicle.

17. An onboard fire suppression system for an automotive vehicle, comprising:

at least one reservoir containing a fire suppressant agent and a propellant for evacuating the fire suppressant agent from the reservoir, with said reservoir adapted for mounting to a vehicle;

a distribution system for receiving the fire suppressant agent from said reservoir, with said distribution system comprising at least one fixed geometry nozzle for discharging the fire suppressant agent in at least one location external to a vehicle;

a sensor system for determining not only whether a vehicle has been subjected to a trigger impact having a magnitude in excess of a predetermined impact threshold, but also whether the vehicle has been moving subsequent to such an impact;

a manually activatable switch, for use by an occupant of a vehicle, to indicate a desire to discharge fire suppressant agent from the reservoir;

a controller, operatively connected with said sensor system, said reservoir, and said manually activatable switch, for causing said propellant to initiate delivery of the fire suppressant agent from the reservoir to the distribution system in the event that: i) either the manually activatable switch has been activated, or ii) the sensor system has determined that a trigger impact has occurred and that either the vehicle's speed has crossed a predetermined threshold following the trigger impact, or that a predetermined period of time has passed following sensing of the trigger impact.

18. An onboard fire suppression system according to claim 17, wherein said sensor system and said controller comprise component parts of a system for controlling the deployment of an occupant restraint airbag.

19. An onboard fire suppression system according to claim 17, wherein said controller further comprises an integral power reserve for operating said controller and said sensor system and for causing the propellant to initiate delivery of the fire suppressant agent.

20. An onboard fire suppression system according to claim 17, wherein said fire suppressant agent comprises an aqueous based liquid.

21. An onboard fire suppression system according to claim 17, wherein said distribution system further comprises at least one variable geometry nozzle.

22. An onboard fire suppression system according to claim 21, wherein said at least one variable geometry nozzle and said at least one fixed geometry nozzle are liquid tight prior to initiation of delivery of the fire suppressant agent.

23. An onboard fire suppression system according to claim 17, comprising a plurality of reservoirs containing fire suppression agent.

24. An automotive vehicle, comprising:

a vehicle body;

a reservoir containing a fire suppressant agent, with said reservoir being mounted in proximity to said body;

a distribution system for receiving the fire suppressant agent from said reservoir and for conducting the fire suppressant agent to at least one location about said body; at least one occupant restraint airbag;

a sensor system for determining whether the vehicle has been subjected to a trigger impact having a severity in excess of a predetermined threshold impact value and whether the vehicle is moving subsequent to such an impact; and a controller, operatively connected with said sensor system, said reservoir, and said occupant restraint airbag, for causing said airbag to deploy and for causing said reservoir to initiate delivery of the fire suppressant agent from the reservoir to the distribution system, in the event that said sensor system determines that a trigger impact has occurred.

25. An automotive vehicle according to claim 24, wherein, following a trigger impact, said controller initiates delivery of the fire suppressant agent in the event that either the vehicle's speed has crossed a predetermined threshold following the trigger impact, or that a predetermined period of time has passed following sensing of the trigger impact.

26. A method for operating a fire suppression system installed in an automotive vehicle, comprising the steps of:

sensing an impact upon the vehicle;

sensing the vehicle's speed following the impact; and discharging a fire suppression agent from an onboard reservoir in the event that both the vehicle's speed crosses a predetermined speed threshold following sensing of an impact and the acceleration of the vehicle crosses a predetermined acceleration threshold.

27. A method for operating a vehicular fire suppression system according to claim 26, further comprising the step of discharging said fire suppression agent after a predetermined period of time following an impact upon the vehicle, in the event that the vehicle's speed has not crossed said predetermined speed threshold and the vehicle's acceleration has not crossed said predetermined acceleration threshold.

28. An automotive vehicle, comprising:

a vehicle body;

a reservoir comprising a tank containing both a fire suppressant agent and a pyrotechnic propellant, with said reservoir being mounted in proximity to said body;

a distribution system for receiving the fire suppressant agent from said reservoir and for conducting the fire suppressant agent to at least one location about said body; a sensor system for determining whether the vehicle has been subjected to an impact and whether the vehicle is moving subsequent to such an impact; and a controller, operatively connected with said sensor system and said reservoir, for causing said propellant to initiate delivery of the fire suppressant agent from the reservoir to the distribution system.

29. An automotive vehicle according to claim 28, wherein said propellant is activated by a plurality of squibs connected by armored wiring to said controller.

* * * * *